US012606405B2

(12) United States Patent
Nakagawa et al.

(10) Patent No.: US 12,606,405 B2
(45) Date of Patent: Apr. 21, 2026

(54) DOCUMENT SHEET CONVEYING DEVICE CAPABLE OF LIFTING UP AND DOWN DISCHARGE OUTLET

(71) Applicant: KYOCERA Document Solutions Inc., Osaka (JP)

(72) Inventors: Takafumi Nakagawa, Osaka (JP); Yoshitaka Tokoro, Osaka (JP); Ren Isoda, Osaka (JP); Hirofumi Hagihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 440 days.

(21) Appl. No.: 18/298,169

(22) Filed: Apr. 10, 2023

(65) Prior Publication Data

US 2023/0322517 A1 Oct. 12, 2023

(30) Foreign Application Priority Data

Apr. 11, 2022 (JP) ..... 2022-065154

(51) Int. Cl.
*B65H 31/10* (2006.01)

(52) U.S. Cl.
CPC ..... *B65H 31/10* (2013.01); *B65H 2557/264* (2013.01)

(58) Field of Classification Search
CPC ..... B65H 31/10; B65H 2557/264
See application file for complete search history.

(56) References Cited

U.S. PATENT DOCUMENTS 4,221,378 A * 9/1980 Kamath ..... B65H 39/11 271/220
5,803,227 A * 9/1998 Stein ..... B65H 31/26 271/84
2019/0233239 A1* 8/2019 Shigeno ..... B65H 29/14

FOREIGN PATENT DOCUMENTS

JP 2019131339 A 8/2019
JP 2019-147648 * 9/2019

* cited by examiner

*Primary Examiner* — Thomas A Morrison
(74) *Attorney, Agent, or Firm* — Alleman Hall LLP

(57) ABSTRACT

A document sheet conveying device includes a guide portion, a swinging shaft, a sheet member, and a biasing member. The guide portion guides a document sheet to the discharge tray. The swinging shaft is provided at an upstream end of the guide portion in a conveyance direction of the document sheet and swingably supports the guide portion with a width direction of the document sheet as an axis direction. One end of the sheet member is fixed to an upstream end of the discharge tray in the conveyance direction, and the other end is supported by the guide portion. As the guide portion is lifted up, the sheet member is drawn out from a part of the guide portion lower than the discharge outlet. The biasing member biases in a direction in which the sheet member is drawn into the guide portion.

5 Claims, 8 Drawing Sheets

DOCUMENT SHEET CONVEYING DEVICE CAPABLE OF LIFTING UP AND DOWN DISCHARGE OUTLET

INCORPORATION BY REFERENCE

This application is based upon and claims the benefit of priority from the corresponding Japanese Patent Application No. 2022-065154 filed on Apr. 11, 2022, the entire contents of which are incorporated herein by reference.

BACKGROUND

The present disclosure relates to a document sheet conveying device for conveying a document sheet to a reading position of an image reading device.

There is known a document sheet conveying device configured to convey a document sheet to a reading position of an image reading device. The document sheet conveying device, for example, includes: a sheet feed tray on which document sheets are stacked; a sheet discharge tray provided below the sheet feed tray; and a conveyance mechanism configured to convey a document sheet along a conveyance path that extends from the sheet feed tray to the sheet discharge tray via the reading position of the image reading device. A sheet discharge outlet is formed at a downstream end of the conveyance path in a conveyance direction, and the document sheet is discharged from the sheet discharge outlet to the sheet discharge tray.

The larger the stack capacity (amount of stackable document sheets) of the sheet discharge tray is, the higher the convenience of the document sheet conveying device is. To achieve a large capacity of the sheet discharge tray, the height of the sheet discharge outlet needs to be increased relative to the sheet discharge tray. However, if the height of the sheet discharge outlet is merely increased, discharged document sheets are disordered in position and attitude, and it takes time and effort for the user to align the document sheets taken out from the sheet discharge tray. For this reason, conventionally, the technology for lifting up and down the sheet discharge outlet has been explored. For example, a configuration for lifting up the sheet discharge outlet in response to a reduction of document sheets supported by the sheet feed tray has been proposed.

SUMMARY

A document sheet conveying device according to an aspect of the present disclosure includes a sheet feed tray, a discharge tray, a conveyance mechanism, a guide portion, a discharge outlet, a first swinging shaft, a drive portion, and a sheet member. On the sheet feed tray, one or more document sheets are stacked. The discharge tray is provided below the sheet feed tray. The conveyance mechanism conveys a document sheet that is one of the one or more document sheets, from the sheet feed tray to the discharge tray via a reading position. The guide portion, at a position downstream of the reading position in a conveyance direction of the document sheet, guides the document sheet to be conveyed. The discharge outlet is provided at a downstream end of the guide portion in the conveyance direction and through which the document sheet is discharged to the discharge tray. The first swinging shaft is provided at an upstream end of the guide portion in the conveyance direction and swingably supports the guide portion with a width direction of the document sheet crossing the conveyance direction as an axis direction. The drive portion swings the guide portion around the first swinging shaft. One end of the sheet member is fixed to an upstream end of the discharge tray in the conveyance direction. The other end of the sheet member is supported by the guide portion. As the guide portion is lifted up, the sheet member is drawn out from a part of the guide portion lower than the discharge outlet, and is stretched between the guide portion and the upstream end of the discharge tray in the conveyance direction.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes, with reference to the accompanying drawings, a document sheet conveying device 120 and an image forming apparatus 100 according to an embodiment of the present disclosure.

Figure 1:
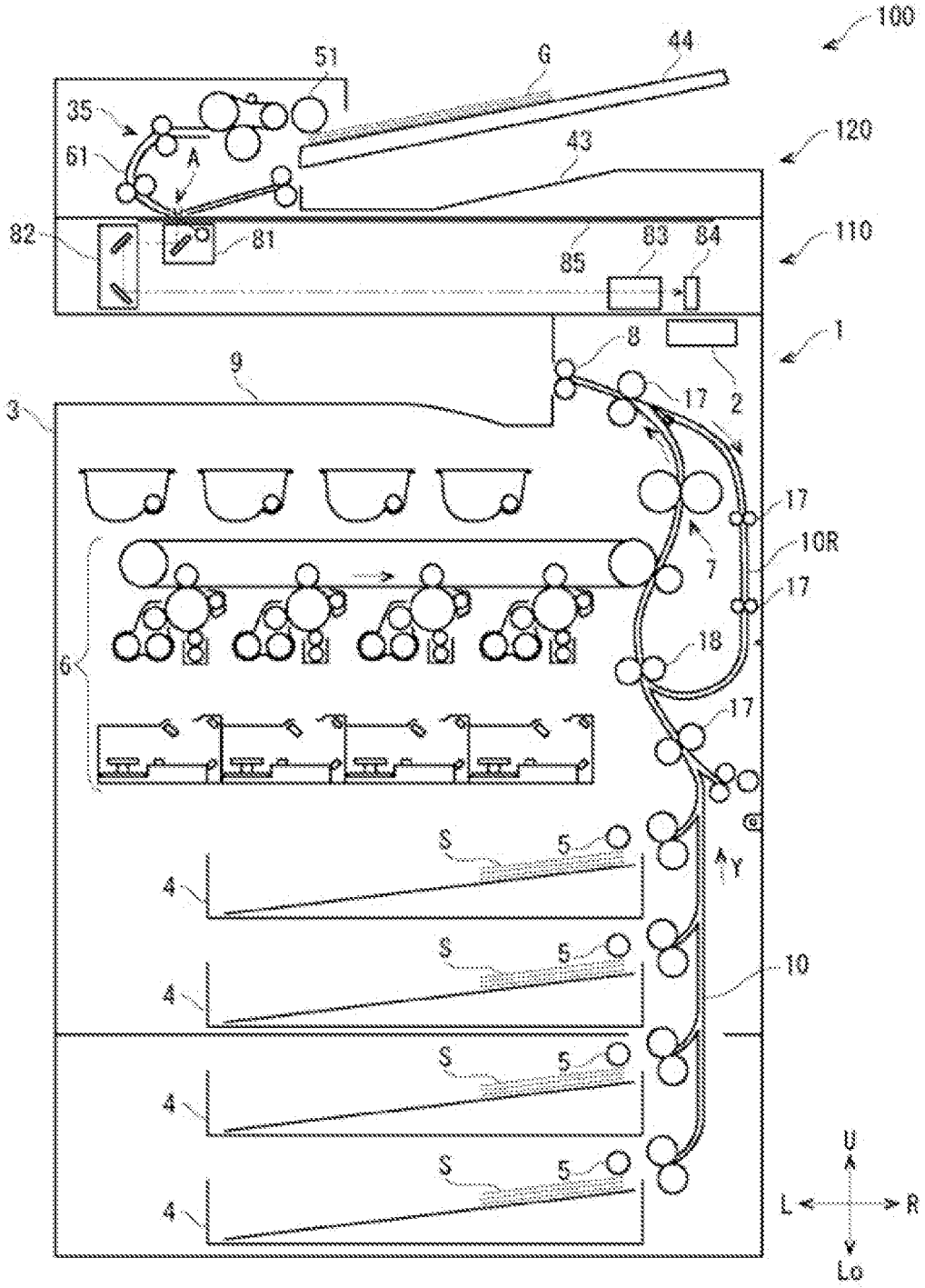
FIG. 1 is a front diagram schematically showing an internal configuration of an image forming apparatus according to an embodiment of the present disclosure.

First, the entire configuration of the image forming apparatus 100 is described. FIG. 1 is a front diagram schematically showing an internal configuration of the image forming apparatus 100. In the following description, it is supposed that the surface of the paper in FIG. 1 is the front side (front) of the image forming apparatus 100, and the left and right directions are based on a direction in which the image forming apparatus 100 is viewed from the front. In each drawing, U, Lo, L, R, Fr, and Rr respectively represent up, low (down), left, right, front, and rear.

The image forming apparatus 100 includes a printer 1, a scanner 110, and the document sheet conveying device 120. The scanner 110 is provided above the printer 1, and the document sheet conveying device 120 is provided above the scanner 110. The document sheet conveying device 120 conveys a document sheet G via a reading position A of the scanner 110. The scanner 110 is an image scanner of a flat bed type, and generates image data by reading the document sheet G. The printer 1 forms an image on a sheet S based on the image data. It is noted that although the present embodiment shows an example in which the printer 1 forms the image by an electrophotographic method, the printer 1 may be configured to form the image by another method (for example, an inkjet method).

The printer 1 includes a main-body housing 3 of a rectangular parallelepiped shape. In a lower part of the main-body housing 3, a sheet feed cassette 4 and a sheet feed roller 5 are provided, wherein the sheet(s) S is stored in the sheet feed cassette 4, and the sheet feed roller 5 feeds the sheet S from the sheet feed cassette 4 rightward. Above the sheet feed cassette 4, an image creating device 6 configured to form a toner image by the electrophotographic method is provided, and on the upper right side of the image creating device 6, a fixing device 7 configured to fix the toner image to the sheet S is provided. Above the fixing device 7, a sheet discharge roller 8 and a sheet discharge tray 9 are provided, wherein the sheet discharge roller 8 discharges the sheet S with the toner image fixed thereto, and the sheet S discharged is stacked on the sheet discharge tray 9.

Inside the main-body housing 3, a conveyance path 10 extending from the sheet feed roller 5 to the sheet discharge roller 8 via the image creating device 6 and the fixing device 7 is provided. The conveyance path 10 is mainly formed of plate-like members facing each other with a space for passing through the sheet S therebetween, and conveyance rollers 17 configured to pinch and convey the sheet S are provided at a plurality of positions in the conveyance path 10 along a conveyance direction Y. A registration roller 18 is provided at an upstream of the image creating device 6 in the conveyance direction Y. A reverse conveyance path 10R is provided on the right side of the fixing device 7, wherein the reverse conveyance path 10R branches from the conveyance path 10 at a downstream of the fixing device 7 in the conveyance direction Y and merges with the conveyance path 10 at an upstream of the registration roller 18 in the conveyance direction Y.

A control portion 2 includes a calculation portion and a storage portion (both not shown). The calculation portion is, for example, a CPU (Central Processing Unit). The storage portion includes storage media such as a ROM (Read Only Memory), a RAM (Random Access Memory), and an EEPROM (Electrically Erasable Programmable Read Only Memory). The calculation portion performs various types of processes by reading and executing control programs stored in the storage portion. It is noted that the control portion 2 may be achieved only by an integrated circuit(s) without using software.

On the front side of the scanner 110, a display/operation portion (not shown) is provided. The display/operation portion includes a display panel, a touch panel provided overlaid on a display surface of the display panel, and a keypad adjacent to the display panel (not shown). The control portion 2 displays, on the display panel, a screen representing an operation menu or a status of the printer 1 or the scanner 110, and controls each portion of the printer 1 or the scanner 110 in response to an operation detected by the touch panel or the keypad.

The basic image forming operation of the printer 1 is as follows. Upon input of a single-sided print job from the display/operation portion, an external computer or the like to the printer 1, the sheet feed roller 5 feeds the sheet S from the sheet feed cassette 4 to the conveyance path 10, the registration roller 18, with its rotation stopped, corrects a skew of the sheet S, and the registration roller 18 feeds the sheet S to the image creating device 6 at a predetermined timing. The image creating device 6 forms a toner image on the sheet S by the electrophotographic method. Subsequently, the fixing device 7 fixes the toner image to the sheet S by melting the toner image while pinching and conveying the sheet S, and the sheet discharge roller 8 discharges the sheet S to the sheet discharge tray 9. In a case of a double-sided printing, the sheet S with the toner image fixed to its first surface is sent to the conveyance path 10 via the reverse conveyance path 10R, and a toner image is transferred to its second surface.

[Scanner]

The scanner 110 includes a first carriage 81 including a light source and a reflection mirror, a second carriage 82 including two reflection mirrors, a lens 83 configured to form an image of light, an imaging element 84 configured to convert the formed image of light to image data, and a contact glass 85 on which the document sheet G is placed.

The basic document sheet reading operation of the scanner 110 is as follows. When the user has placed the document sheet G on an upper surface of the contact glass 85 and instructed the scanner 110 to read, the first carriage 81 moves rightward at a speed V, and, in conjunction with this, the second carriage 82 moves rightward at a speed V/2. During the same period, the light source emits light toward the document sheet G, a reflection light reflected by the document sheet G is reflected by the reflection mirror of the first carriage 81 and the reflection mirrors of the second carriage 82 to be guided to the lens 83, and an image of the light is formed in the imaging element 84 and converted to an image signal. The image signal is output to the control portion 2 of the printer 1 and converted to the image data.

[Document Sheet Conveying Device]

Figure 2:
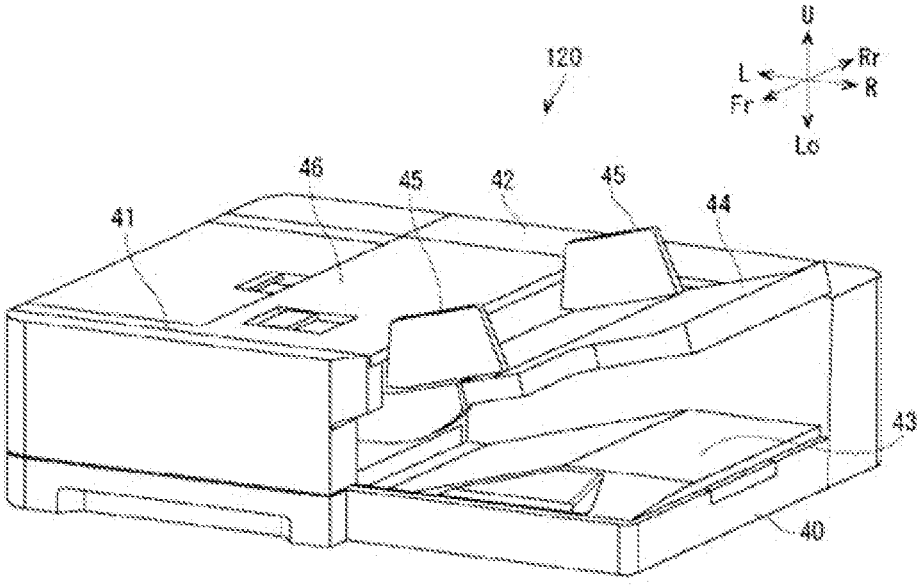
FIG. 2 is a perspective diagram showing an outer appearance of a document sheet conveying device according to the embodiment of the present disclosure.
Figure 3:
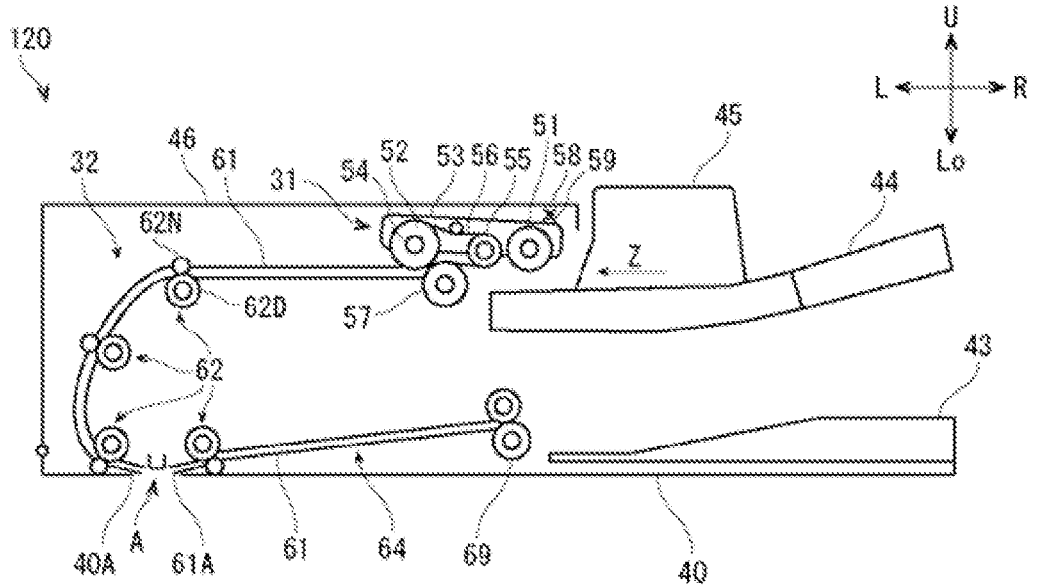
FIG. 3 is a front diagram schematically showing a sheet feed mechanism and a conveyance mechanism according to the embodiment of the present disclosure.
Figure 4:
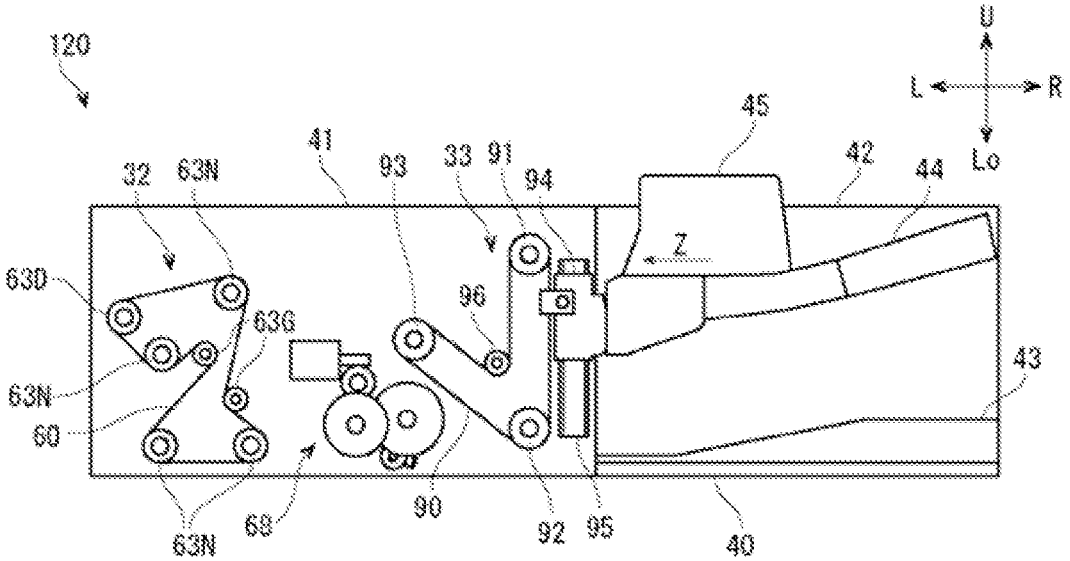
FIG. 4 is a front diagram schematically showing the conveyance mechanism and a sheet feed tray lift mechanism according to the embodiment of the present disclosure.
Figure 5:
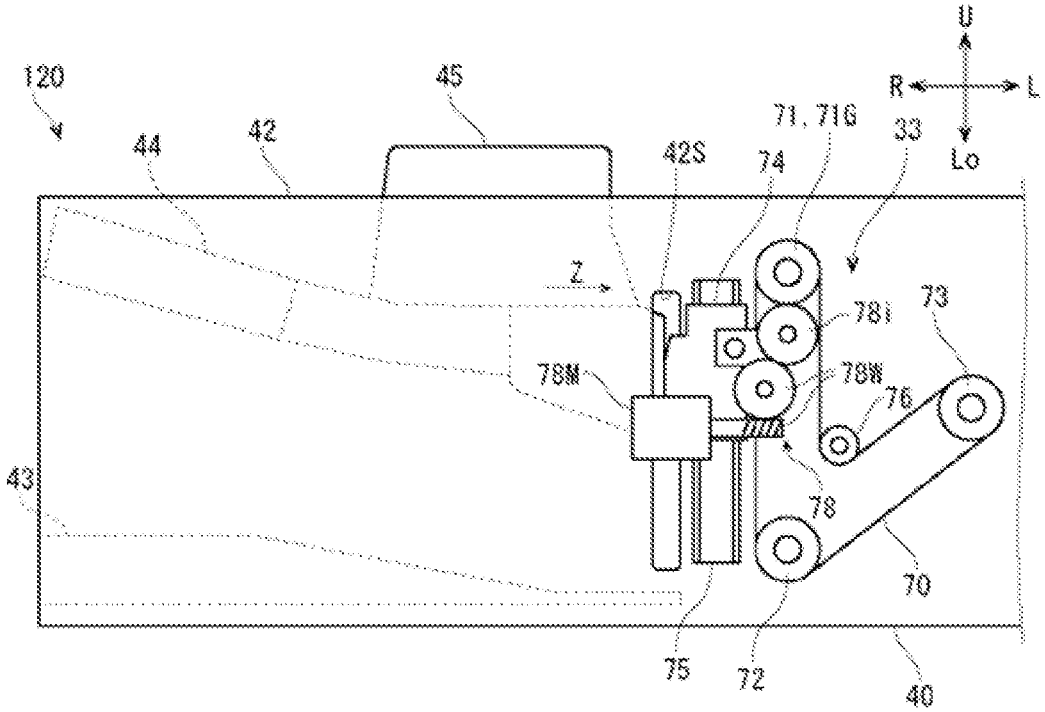
FIG. 5 is a rear diagram schematically showing the sheet feed tray lift mechanism and a drive portion according to the embodiment of the present disclosure.
Figure 6:
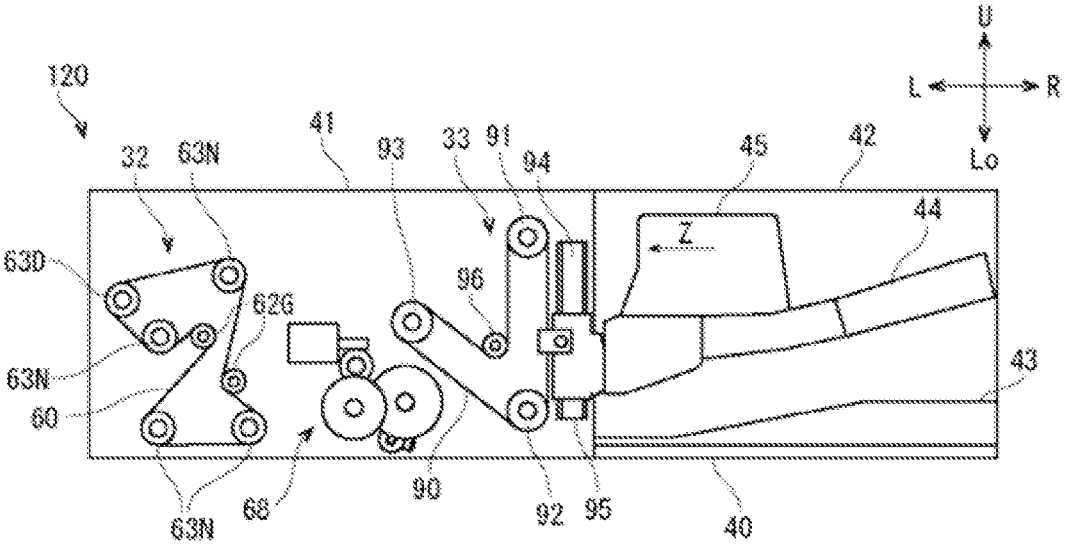
FIG. 6 is a front diagram schematically showing the conveyance mechanism and the sheet feed tray lift mechanism according to the embodiment of the present disclosure.

Next, the document sheet conveying device 120 is described. FIG. 2 is a perspective diagram showing an outer appearance of the document sheet conveying device 120. FIG. 3 is a front diagram schematically showing a sheet feed mechanism 31 and a conveyance mechanism 32. FIG. 4 and FIG. 6 are front diagrams schematically showing the conveyance mechanism 32 and a sheet feed tray lift mechanism 33. FIG. 5 is a rear diagram schematically showing the sheet feed tray lift mechanism 33 and a drive portion 78. Of these, FIG. 3, FIG. 4, and FIG. 5 show that a sheet feed tray 44 is located at an upper-limit position, and FIG. 6 shows that the sheet feed tray 44 is located at a lower-limit position.

The document sheet conveying device 120 (see FIG. 2, FIG. 3) includes a bottom portion 40, a first wall portion 41, and a second wall portion 42, wherein the bottom portion 40 is formed in an approximately rectangular, flat shape, the first wall portion 41 and the second wall portion 42 face each other in a front-rear direction (a width direction crossing a conveyance direction Z of the document sheet G). A rear edge part of the bottom portion 40 is hinge-connected with a rear end of the contact glass 85 (see FIG. 1) of the scanner 110. The bottom portion 40 also has a function of a pressing plate to press the document sheet G on the contact glass 85. The first wall portion 41 extends from a left end part to a center part of a front edge part of the bottom portion 40. The second wall portion 42 extends in the entirety of a rear edge part of the bottom portion 40. A cover portion 46 covers an upper part and a left side part of a space between the first wall portion 41 and the second wall portion 42. A lower left end part of the cover portion 46 is hinge-connected with a left end part of the bottom portion 40.

[Sheet Feed Tray]

The sheet feed tray 44 (see FIG. 2, FIG. 3) is provided on the right side of the center of the document sheet conveying device 120 in a left-right direction and on the front side of the second wall portion 42. The sheet feed tray 44 is a plate-like member that is inclined to be lowered to the left. On an upper surface of the sheet feed tray 44, a pair of cursors 45 for aligning end parts of the document sheet G in the front-rear direction are provided. The cursors 45 are configured to be slid in the front-rear direction.

[Discharge Tray]

A discharge tray 43 is provided below the sheet feed tray 44. The discharge tray 43 is integral with the bottom portion 40. At a center part of the discharge tray 43 in the left-right direction, an inclined surface inclined to be lowered to the left is provided.

[Sheet Feed Mechanism]

The sheet feed mechanism 31 (see FIG. 3) is provided in the space between the first wall portion 41 and the second wall portion 42. The sheet feed mechanism 31 includes a holder 53 in a shape of a box whose lower part is open. Inside the holder 53, a feed roller 51, a driven roller 55, a driving roller 52, an endless belt 56, and a retard roller 57 are disposed with the front-rear direction as an axis direction. The driven roller 55 is provided at the left of the feed roller 51. The driving roller 52 is provided at the left of the driven roller 55. The endless belt 56 is wound around the driving roller 52 and the driven roller 55. The retard roller 57 is pressed against a lower surface of a lower part of the endless belt 56.

A front end part and a rear end part of a drive shaft 54 of the driving roller 52 are supported by the first wall portion 41 and the second wall portion 42, and are connected to a drive portion (not shown) that includes a motor and a speed reduction gear. The holder 53 is supported by and swingable around the drive shaft 54. The driving force of the drive shaft 54 is transmitted to the feed roller 51 and the retard roller 57 by a transmission mechanism (not shown) such as a gear train or an endless belt.

A sensor 58 is an optical sensor of a transmission type or a reflection type provided on an inner surface of the cover portion 46. On the holder 53, a light shielding plate 59 projecting upward or sideways is provided. The sensor 58 outputs, to the control portion 2, a detection signal whose level is different depending on whether the light shielding plate 59 is shielding light from the sensor 58 or not.

[Sheet Feed Tray Lift Mechanism]

The sheet feed tray lift mechanism 33 (see FIG. 4, FIG. 5) is provided on a front surface of the first wall portion 41 and a rear surface of the second wall portion 42. A driving pulley 71 and a driven pulley 72 (see FIG. 5) are respectively provided at an upper part and a lower part of the rear surface of the second wall portion 42. A driven pulley 73 is provided at a height between the driving pulley 71 and the driven pulley 72 and the left of the driving pulley 71 and the driven pulley 72. A guide pulley 76 is provided at the upper left of the driven pulley 72 and the right of the driven pulley 73. An endless belt 70 is wound around the driving pulley 71, the driven pulleys 72, 73, and the guide pulley 76. The drive portion 78 includes a motor 78M, a worm gear 78W, an idler gear 78*i*, and a drive gear 71G. The drive gear 71G is provided at a shaft of the driving pulley 71.

Driven pulleys 91, 92, 93 and a guide pulley 96 (see FIG. 4) are provided on the front surface of the first wall portion 41 at positions respectively facing the driving pulley 71, the driven pulleys 72, 73, and the guide pulley 76. An endless belt 90 is wound around the driven pulleys 91, 92, 93 and the guide pulley 96. The driven pulley 93 is provided at a shaft common to the driven pulley 73.

A slide portion 74 (see FIG. 5) is provided at a left end part of a rear edge part of the sheet feed tray 44. The second wall portion 42 has a slit 42S elongated in an up-down direction. The slit 42S is provided at a position corresponding to the left end part of the rear edge part of the sheet feed tray 44. The slide portion 74 passes through the slit 42S and is coupled with a part of the endless belt 70 between the driving pulley 71 and the driven pulley 72.

A lift guide portion 75 is provided on the rear surface of the second wall portion 42. The lift guide portion 75 is a rail-like member elongated in the up-down direction. The slide portion 74 is configured to slide in the up-down direction along the lift guide portion 75.

A slide portion 94 (see FIG. 4) is provided at a left end part of a front edge part of the sheet feed tray 44. The slide portion 94 is coupled with a part of the endless belt 90 between the driven pulley 91 and the driven pulley 92.

A lift guide portion 95 is provided on the front surface of the first wall portion 41. The lift guide portion 95 is a rail-like member elongated in the up-down direction. The slide portion 94 is configured to slide in the up-down direction along the lift guide portion 95.

The basic operation of the sheet feed tray lift mechanism 33 is as follows. A driving force that the motor 78M generates is transmitted to the drive gear 71G via the worm gear 78W and the idler gear 78*i*, causing the drive gear 71G to rotate. The driving pulley 71 rotates together with the drive gear 71G. This causes the endless belt 70 to circumferentially rotate, and in conjunction with this, the driven pulleys 72, 73 rotate. In addition, the driven pulley 93 rotates together with the driven pulley 73, causing the endless belt 90 to circumferentially rotate in synchronization with the endless belt 70. Since the sheet feed tray 44 is coupled with the endless belts 70, 90 via the slide portions 74, 94, the sheet feed tray 44 is lifted up and down by a normal rotation and a reverse rotation of the motor 78M.

The control portion 2 causes the sheet feed tray lift mechanism 33 to lift up the sheet feed tray 44. When the upper surface of the document sheet G stacked on the sheet feed tray 44 is pressed against the feed roller 51, the holder 53 swings upward. When the holder 53 swings upward by a predetermined amount, the light shielding plate 59 shields the light of the sensor 58. At this time, an appropriate load acts between the upper surface of the document sheet G and the feed roller 51, causing the feed roller 51 to feed the document sheet G. In other words, the control portion 2 controls the sheet feed tray lift mechanism 33 in such a way as to lift up the sheet feed tray 44 as the amount of document sheets G stacked on the sheet feed tray 44 decreases.

[Conveyance Mechanism]

The conveyance mechanism 32 (see FIG. 3) includes a conveyance path 61 and a plurality of conveyance rollers 62, wherein the conveyance path 61 extends from the sheet feed mechanism 31 to a discharge roller 69 via an opening portion 40A, and the plurality of conveyance rollers 62 are disposed at the conveyance path 61. The conveyance path 61 is mainly formed of plate-like members facing each other with a space for passing through the document sheet G therebetween. The opening portion 40A is a slit elongated in the front-rear direction and is provided in a region of the bottom portion 40 that faces the first carriage 81 (see FIG. 1) located at a home position. The opening portion 40A is an example of the reading position A where the scanner 110 reads the document sheet G. At the reading position A, an opening portion 61A is provided in a plate-like member below the conveyance path 61 at a position corresponding to the opening portion 40A, and a lower surface of the document sheet G being conveyed is exposed below via the opening portion 40A and the opening portion 61A.

The conveyance rollers 62 include a driving roller 62D and a driven roller 62N (see FIG. 3). A driven pulley 63N (see FIG. 4) is provided at a shaft of the driving roller 62D. A driving pulley 63D is connected to a drive portion (not shown) that includes a motor and a speed reduction gear. An endless belt 60 is wound around the driving pulley 63D, a plurality of driven pulleys 63N, and a guide pulley 63G. When the driving pulley 63D is driven, the endless belt 60 circumferentially rotates, and the plurality of driven pulleys 63N rotate in synchronization therewith. This causes the plurality of conveyance rollers 62 to rotate in synchronization therewith.

Meanwhile, as a related technology, a document sheet conveying device is known in which a discharge outlet 69A (see FIG. 11) is lifted up as the amount of document sheets G supported by the sheet feed tray 44 decreases. This document sheet conveying device includes a first abutting surface and a second abutting surface, wherein the first abutting surface projects upward from a sheet support surface of the discharge tray 43 and is oriented in a discharge direction in which a sheet is discharged to the discharge tray 43, and the second abutting surface moves upward, together with a discharge unit, to be higher than the first abutting surface and is oriented in the discharge direction. The larger the number of stacked sheets supported by the sheet support surface of the discharge tray 43 is, the higher the position to which the discharge outlet 69A moves is and the larger the amount by which the second abutting surface moves upward is. The first abutting surface and the second abutting surface abut on an end edge of the sheets on the sheet support surface on the upstream side in the discharge direction, thereby restricting the position shift of the sheets.

However, in the document sheet conveying device according to the above-mentioned related technology, the maximum height of an abutting surface formed by the first abutting surface and the second abutting surface is determined by the total of the heights of the first abutting surface and the second abutting surface. When the maximum height of the abutting surface is increased to achieve a large capacity, the minimum height is also increased, and the size of the document sheet conveying device in the up-down direction becomes large. In addition, in a case where the amount of document sheets G stacked in the discharge tray 43 is small, the document sheets G are scattered.

On the other hand, as described in the following, the document sheet conveying device 120 according to the embodiment of the present disclosure achieves a large capacity and a small space without deteriorating the compatibility of the document sheets G stacked on the discharge tray 43.

[Discharge Outlet Lift Mechanism]

Figure 7:
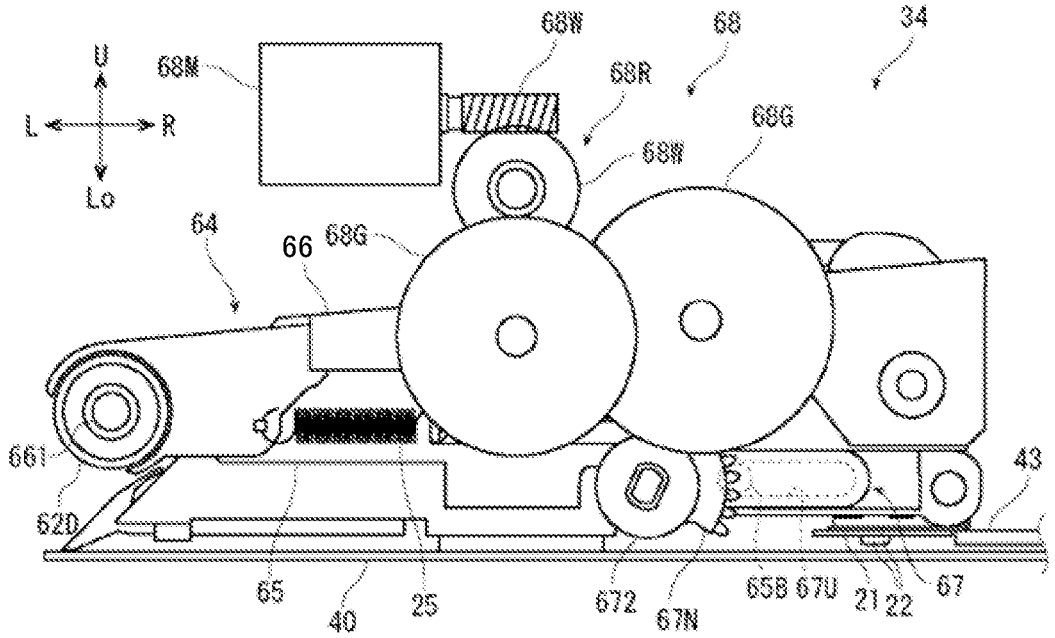
FIG. 7 is a front diagram showing a discharge outlet lift mechanism according to the embodiment of the present disclosure.
Figure 8:
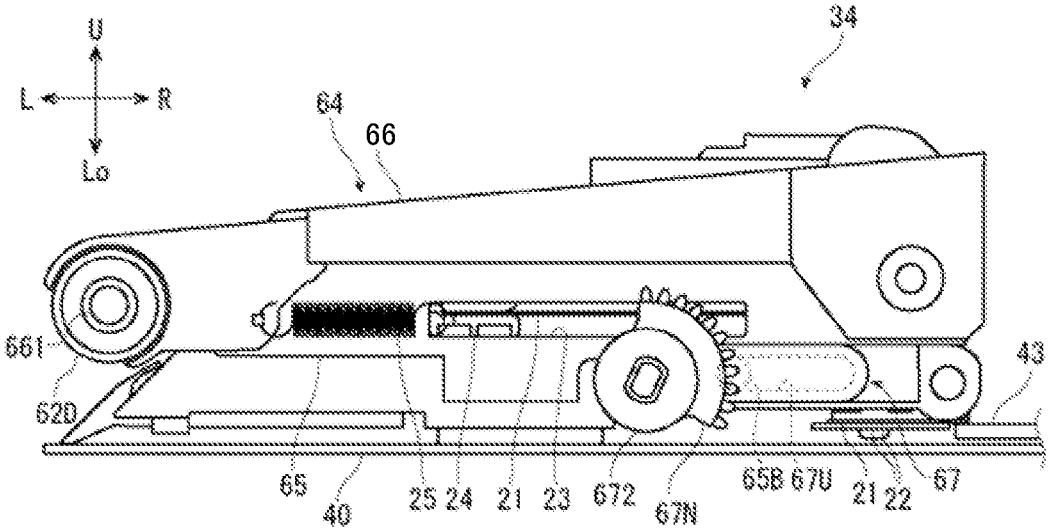
FIG. 8 is a front diagram showing the discharge outlet lift mechanism (omitting a drive portion) according to the embodiment of the present disclosure.
Figure 9:
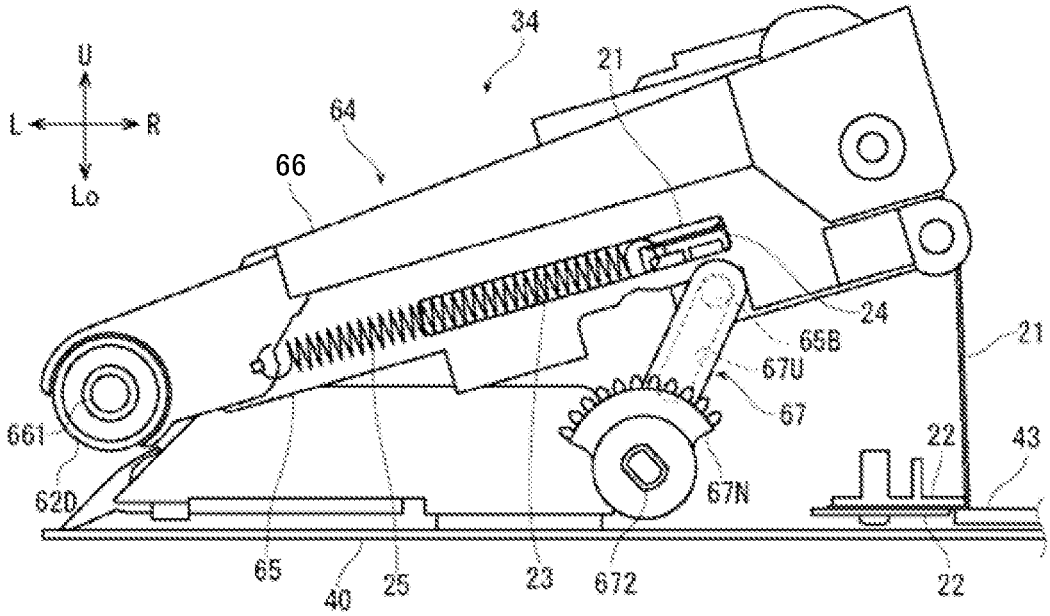
FIG. 9 is a front diagram showing a state where a guide portion has been lifted up according to the embodiment of the present disclosure.
Figure 10:
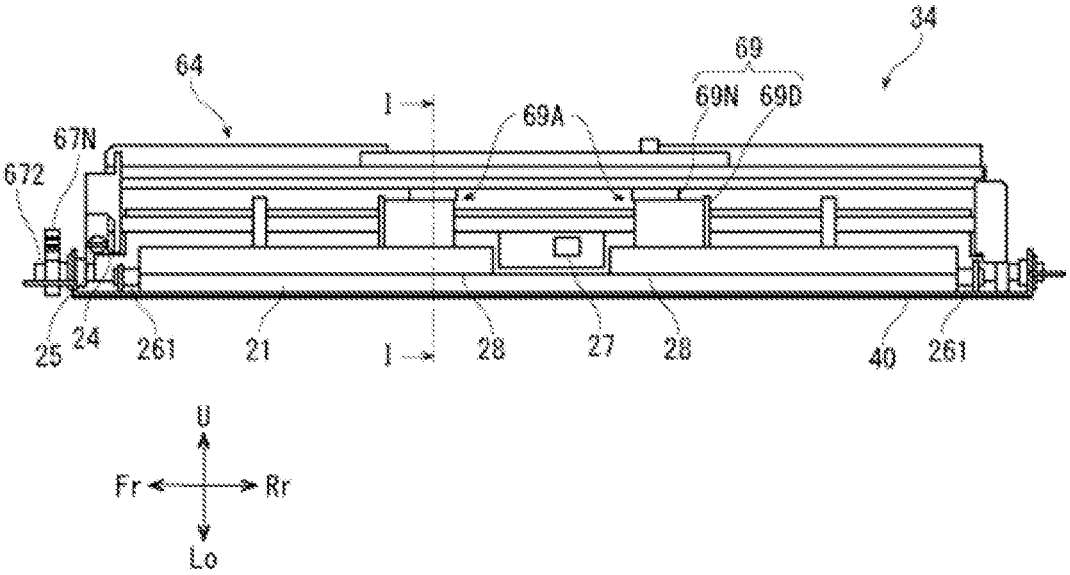
FIG. 10 is a right side diagram showing the discharge outlet lift mechanism (omitting the drive portion) according to the embodiment of the present disclosure.
Figure 11:
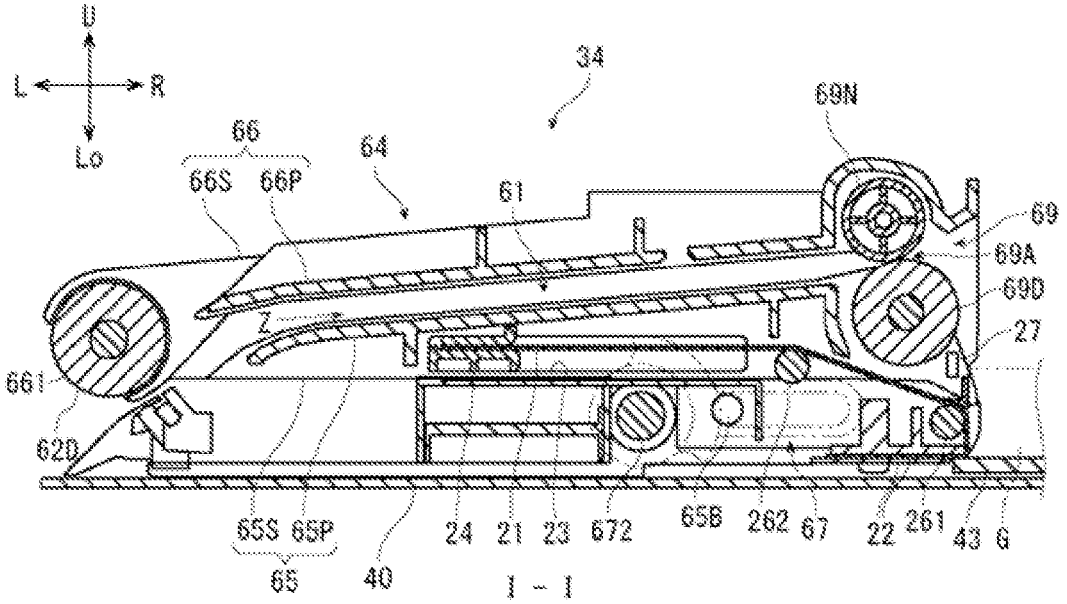
FIG. 11 is a cross-section diagram showing the discharge outlet lift mechanism according to the embodiment of the present disclosure.

FIG. 7 is a front diagram showing a discharge outlet lift mechanism 34. FIG. 8 is a front diagram showing the discharge outlet lift mechanism 34 (omitting a drive portion 68). FIG. 9 is a front diagram showing a state where a guide portion 64 has been lifted up. FIG. 10 is a right side diagram showing the discharge outlet lift mechanism 34 (omitting the drive portion 68). FIG. 11 is a cross-section diagram showing the discharge outlet lift mechanism 34.

[Guide Portion]

The guide portion 64 (see FIG. 7 to FIG. 11) is provided in the conveyance path 61 at a position downstream of the opening portion 40A in the conveyance direction Z. The guide portion 64 is integrated with a lower guide portion 65 and an upper guide portion 66 that face each other in the up-down direction. The lower guide portion 65 (see FIG. 11) includes: a plate-like portion 65P forming a lower part of the conveyance path 61; and support portions 65S supporting the front and rear end parts of the plate-like portion 65P. The upper guide portion 66 includes: a plate-like portion 66P forming an upper part of the conveyance path 61; and support portions 66S supporting the front and rear end parts of the plate-like portion 66P. Left end parts of the support portions 66S supporting the front and rear parts of the upper guide portion 66 are supported by a first swinging shaft 661 that is a shaft of the driving roller 62D adjacent to the right side of the opening portion 40A. The guide portion 64 is configured to swing around the first swinging shaft 661.

At a right end part of the guide portion 64, the discharge roller 69 is provided. The discharge roller 69 includes a driving roller 69D and a driven roller 69N, wherein the driven roller 69N is disposed above the driving roller 69D. The driving roller 69D is supported by right end parts of the support portions 65S of the lower guide portion 65, and the driven roller 69N is supported by right end parts of the support portions 66S of the upper guide portion 66. A contact area where the driving roller 69D and the driven roller 69N are in contact with each other is located at a downstream end of the guide portion 64 in the conveyance direction Z, forming the discharge outlet 69A through which the document sheet G is discharged from the guide portion 64.

Cylindrical projection portions 65B are provided on the support portions 65S supporting the front and rear parts of the lower guide portion 65 (see FIG. 11). The projection portion 65B provided at the front support portion 65S projects frontward, and the projection portion 65B provided at the rear support portion 65S projects rearward. The projection portion 65B is formed, for example, by inserting a caulking pin in a through hole formed in the support portion 65S. The projection portions 65B are located separate from the first swinging shaft 661. The projection portions 65B are provided on the right side of the center of the lower guide portion 65 in the left-right direction.

[Coupling Member]

A coupling member 67 is provided at the front and the rear of the lower guide portion 65. The coupling member 67 is supported by a second swinging shaft 672 provided in an area of the bottom portion 40 corresponding to a lower part of the guide portion 64, and the front and rear coupling members 67 are integrally swung around the second swinging shaft 672. The second swinging shaft 672 is provided between the first swinging shaft 661 and the projection portion 65B.

The coupling member 67 includes a groove portion 67U elongated in an approaching and separating direction to the second swinging shaft 672. The width of the groove portion 67U is slightly wider than a diameter of the projection portion 65B. The projection portion 65B is inserted in the groove portion 67U and is configured to slide along the groove portion 67U.

[Drive Portion]

Either the first wall portion 41 or the second wall portion 42 (in the present embodiment, the first wall portion 41) includes a drive portion 68 that drives the coupling member 67 (see FIG. 7). The coupling member 67 on the front side includes a driven gear 67N arranged around the second swinging shaft 672. The drive portion 68 includes a motor 68M and a speed reduction gear train 68R. The speed reduction gear train 68R includes a worm gear 68W and one or more gears 68G, wherein the worm gear 68W is provided at the motor 68M, and the one or more gears 68G transmit a driving force from the worm gear 68W to the driven gear 67N. When the motor 68M is driven, a driving force is transmitted to the driven gear 67N via the speed reduction gear train 68R, and the front and rear coupling members 67 are integrally swung.

For example, when the motor 68M in an initial state as shown in FIG. 8 is driven, the coupling member 67 is swung counterclockwise around the second swinging shaft 672 as shown in FIG. 9. As the coupling member 67 is swung, the projection portion 65B slides along the groove portion 67U of the coupling member 67 in a direction of separating from the second swinging shaft 672, thus the guide portion 64 is swung counterclockwise around the first swinging shaft 661, and the discharge outlet 69A is lifted up.

On the other hand, when the motor 68M is driven in the reverse direction, the coupling member 67 is swung clockwise, the projection portion 65B slides in a direction of approaching the second swinging shaft 672, thus the guide portion 64 is swung clockwise, and the discharge outlet 69A is lifted down.

[Sensor]

A sensor 27 (see FIG. 10, FIG. 11) is provided at a downstream end of the lower guide portion 65 in the conveyance direction. The sensor 27 is, for example, a reflection type optical sensor. The sensor 27 includes a light emitting element and a light receiving element (not shown). The light emitting element emits light in the conveyance direction Z. When the height of the document sheets G stacked on the discharge tray 43 reaches the position of the sensor 27, the light is reflected by the document sheets G. The light receiving element receives a reflection light from the document sheets G. The sensor 27 transmits, to the control portion 2, a detection signal indicating whether or not the light receiving element has received light. A detection signal of a first level is transmitted when the light receiving element does not receive light, and a detection signal of a second level is transmitted when the light receiving element receives light. When the detection signal has changed from the first level to the second level, the control portion 2 controls the discharge outlet lift mechanism 34 to lift up the discharge outlet 69A by a predetermined amount. In other words, the control portion 2 controls the discharge outlet lift mechanism 34 to lift up or down the discharge outlet 69A according to the amount of document sheets G stacked on the discharge tray 43.

Next, a configuration for stretching a sheet member 21 is described. The document sheet conveying device 120 includes: the sheet feed tray 44 on which the document sheets G are stacked; the discharge tray 43 provided below the sheet feed tray 44; the conveyance mechanism 32 configured to convey the document sheet G from the sheet feed tray 44 to the discharge tray 43 via the reading position A; the guide portion 64 configured to, at a position downstream of the reading position A in the conveyance direction Z of the document sheet G, guide the document sheet G to be conveyed; the discharge outlet 69A which is provided at a downstream end of the guide portion 64 in the conveyance direction Z and through which the document sheet G is discharged to the discharge tray 43; the first swinging shaft 661 (an example of a swinging shaft) provided at an upstream end of the guide portion 64 in the conveyance direction Z and swingably supporting the guide portion 64 with the width direction of the document sheet G crossing the conveyance direction Z as an axis direction; the drive portion 68 configured to swing the guide portion 64 around the first swinging shaft 661; the sheet member 21 whose one end is fixed to an upstream end of the discharge tray 43 in the conveyance direction Z, whose other end is supported by the guide portion 64, and which is, as the guide portion 64 is lifted up, drawn out from a part of the guide portion 64 lower than the discharge outlet 69A; and a biasing member 25 configured to bias in a direction in which the sheet member 21 is drawn into the guide portion 64. It is noted that since the sheet feed tray 44, the discharge tray 43, the conveyance mechanism 32, the guide portion 64, the first swinging shaft 661, the drive portion 68, and the discharge outlet 69A are described above, the following mainly describes the sheet member 21, the biasing member 25 and the like.

[Sheet Member]

The sheet member 21 (see FIG. 11) is a film formed from a resin such as polyester. One end of the sheet member 21 is fixed to a fixing member 22 that is adjacent to the upstream end of the discharge tray 43 in the conveyance direction Z.

[Slit, Slide Member, Biasing Member]

Each of the front and rear support portions 65S of the lower guide portion 65 (see FIG. 11) has a slit 23 extending approximately along the conveyance direction Z. A slide member 24 is supported by the slit 23, and configured to slide in a range of the length of the slit 23 along the slit 23. The other end of the sheet member 21 is coupled with the slide member 24. The biasing member 25 (see FIG. 7 to FIG. 10) is a tension coil spring that expands and contracts along the longitudinal direction of the slit 23. One end of the biasing member 25 is coupled with a part of the support portion 65S located upstream of the slit 23 in the conveyance direction Z, and the other end of the biasing member 25 is coupled with the slide member 24. The biasing member 25 biases the slide member 24 in a reverse direction to the conveyance direction Z.

[First Stretching Member, Second Stretching Member]

Below the discharge outlet 69A, a first stretching member 261 (see FIG. 11) is provided. Located downstream of the slit 23 in the conveyance direction, a second stretching member 262 is provided. The first stretching member 261 and the second stretching member 262 are each a roller member which is elongated in the width direction and whose cross-section is circular. The front and rear end parts of the first stretching member 261 and the second stretching member 262 are supported by the front and rear support portions 65S of the lower guide portion 65. The first stretching member 261 and the second stretching member 262 may be rotatable.

The sheet member 21 is stretched over the fixing member 22, the first stretching member 261, the second stretching member 262, and the slide member 24. Since the slide member 24 is biased by the biasing member 25 in a reverse direction to the conveyance direction Z, a tension is always applied to the sheet member 21. A part of the sheet member 21 that is stretched over the fixing member 22 and the first stretching member 261 forms a wall standing erect between an upstream end of the discharge tray 43 in the conveyance direction Z and the discharge outlet 69A.

[Cover Member]

Between the first stretching member 261 and the discharge roller 69, a cover member 28 (see FIG. 10, FIG. 11) is provided. The cover member 28 is a plate-like member elongated in the front-rear direction. The cover member 28 is thick in the conveyance direction Z and is disposed such that the sheet member 21 is sandwiched between the first stretching member 261 and a lower end part of the cover member 28. The cover member 28 prevents the discharged document sheet G from entering between the sheet member 21 and the discharge roller 69.

Figure 12:
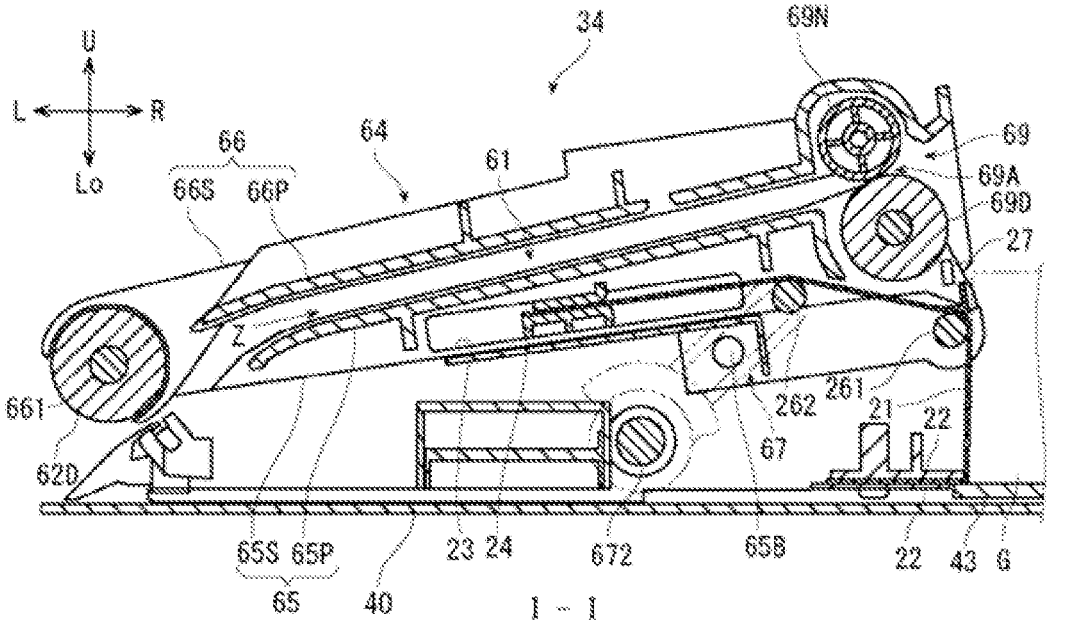
FIG. 12 is a cross-section diagram showing the discharge outlet lift mechanism according to the embodiment of the present disclosure.
Figure 13:
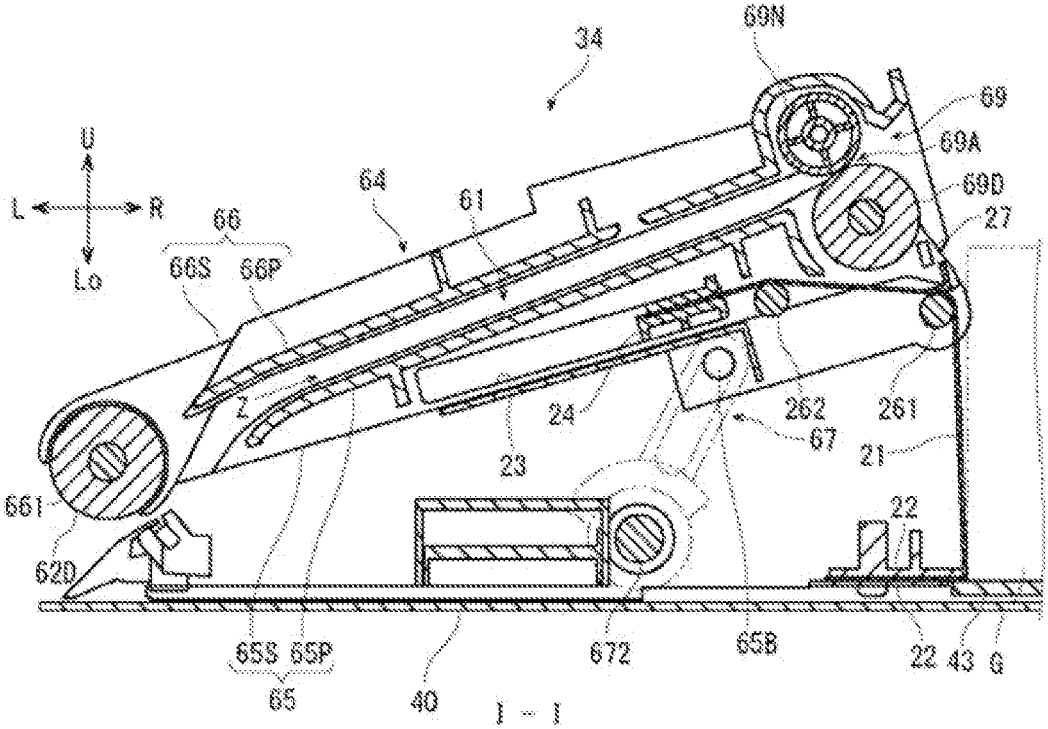
FIG. 13 is a cross-section diagram showing the discharge outlet lift mechanism according to the embodiment of the present disclosure.

Next, an operation of the document sheet conveying device 120 is described. FIG. 11 to FIG. 13 are cross-section diagrams showing the discharge outlet lift mechanism 34. Of these, FIG. 11 shows that the guide portion 64 is located at a lower-limit position, FIG. 13 shows that the guide portion 64 is located at an upper-limit position, and FIG. 12 shows that the guide portion 64 is located at a position between the lower-limit position and the upper-limit position.

When the guide portion 64 is located at the lower-limit position (see FIG. 11), the inclination of the conveyance path 61 is the smallest (the closest to the horizontal), and the heights of the discharge outlet 69A and the first stretching member 261 are the lowest. Accordingly, the height of the wall formed by the sheet member 21 is the lowest. In addition, the slide member 24 is located at an upstream end of the slit 23 in the conveyance direction Z, and the sheet member 21 has been drawn in most by the guide portion 64.

When reading of the document sheets G stacked on the sheet feed tray 44 is performed, the document sheets G are discharged one by one to the discharge tray 43. The discharged document sheet G slides down leftward according to the inclination of the discharge tray 43, and stops, with the left end part of the document sheet G coming in contact with the wall formed by the sheet member 21.

When the height of the upper surface of the document sheets G stacked on the discharge tray 43 reaches a height where they are detected by the sensor 27 (see FIG. 11), the detection signal of the sensor 27 changes from the first level to the second level, and the control portion 2 controls the discharge outlet lift mechanism 34 to lift up the discharge outlet 69A by a predetermined amount (see FIG. 12). As the discharge outlet 69A is lifted up, the sheet member 21 is drawn out from the guide portion 64, the height of the wall becomes high, and the slide member 24 is drawn toward the downstream in the conveyance direction Z. It is noted that in the present example, to facilitate the understanding, the amount of change of the height of the discharge outlet 69A between FIG. 11 and FIG. 12 is expressed greatly. However, in reality, the amount of change of the height of the discharge outlet 69A can be freely set.

When the guide portion 64 is located at the upper-limit position (see FIG. 13), the inclination of the conveyance path 61 is the largest, and the heights of the discharge outlet 69A and the first stretching member 261 are the highest. Accordingly, the height of the wall formed by the sheet member 21 is the highest. In addition, the slide member 24 is located at a downstream end of the slit 23 in the conveyance direction Z, and the sheet member 21 has been drawn out most from the guide portion 64.

When the document sheets G stacked on the discharge tray 43 are taken out, the detection signal of the sensor 27 changes from the second level to the first level. This causes the control portion 2 to lift down the discharge outlet 69A by a predetermined amount. When the detection signal does not change from the first level to the second level after the control portion 2 lifts down the discharge outlet 69A by the predetermined amount, the control portion 2 further lifts down the discharge outlet 69A by a predetermined amount. When no document sheet G is left in the discharge tray 43, the detection signal remains to be the first level, and thus the discharge outlet 69A is lifted down to the lower-limit position.

The above-described document sheet conveying device 120 according to the present embodiment includes: the sheet feed tray 44 on which the document sheets G are stacked; the discharge tray 43 provided below the sheet feed tray 44; the conveyance mechanism 32 configured to convey the document sheet G from the sheet feed tray 44 to the discharge tray 43 via the reading position A; the guide portion 64 configured to, at a position downstream of the reading position A in the conveyance direction Z of the document sheet G, guide the document sheet G to be conveyed; the discharge outlet 69A which is provided at a downstream end of the guide portion 64 in the conveyance direction Z and through which the document sheet G is discharged to the discharge tray 43; the first swinging shaft 661 (an example of a swinging shaft) provided at an upstream end of the guide portion 64 in the conveyance direction Z and swingably supporting the guide portion 64 with the width direction of the document sheet G crossing the conveyance direction Z as an axis direction; the drive portion 68 configured to swing the guide portion 64 around the first swinging shaft 661; the sheet member 21 whose one end is fixed to an upstream end of the discharge tray 43 in the conveyance direction Z, whose other end is supported by the guide portion 64, and which is, as the guide portion 64 is lifted up, drawn out from a part of the guide portion 64 lower than the discharge outlet 69A; and the biasing member 25 configured to bias in a direction in which the sheet member 21 is drawn into the guide portion 64.

With the above-described configuration, since a tension is applied to the sheet member 21 by the biasing member 25, a wall of the sheet member 21 standing erect is formed between an upstream end of the discharge tray 43 in the conveyance direction Z and the discharge outlet 69A. As the discharge outlet 69A is lifted up, the sheet member 21 is drawn out from the guide portion 64, and the height of the wall becomes high. On the other hand, as the discharge outlet 69A is lifted down, the sheet member 21 is drawn into the guide portion 64, and the height of the wall becomes lower. Since the sheet member 21 is flexible, it is possible to make the maximum height of the wall higher, and the minimum height of the wall lower, than those of the conventional configuration. It is thus possible to expand the swinging range of the guide portion 64, too. Therefore, according to the document sheet conveying device 120 of the present embodiment, it is possible to achieve a large capacity and a small space without deteriorating the compatibility of the document sheets G stacked on the discharge tray 43.

In addition, the document sheet conveying device 120 according to the present embodiment includes a stretching member (first stretching member 261) that is provided along the width direction at a part of the guide portion 64 lower than the discharge outlet 69A, and configured to stretch the sheet member 21 between an upstream end of the discharge tray 43 in the conveyance direction Z and the discharge outlet 69A. With this configuration, it is possible to form a stable wall between an upstream end of the discharge tray 43 in the conveyance direction Z and the discharge outlet 69A.

In addition, according to the document sheet conveying device 120 of the present embodiment, the other end of the sheet member 21 is supported by the guide portion 64 in such a way as to be slidable along the conveyance direction Z and its reverse direction, and the biasing member 25 biases the other end in the direction reverse to the conveyance direction Z. With this configuration, it is possible to draw in and draw out the sheet member 21 with a simple configuration.

In addition, the document sheet conveying device 120 according to the present embodiment includes the sensor 27 that detects the amount of document sheets G stacked on the discharge tray 43, and the drive portion 68 swings the guide portion 64 according to the amount of document sheets G detected by the sensor 27. With this configuration, it is possible to change the height of the wall according to the amount of document sheets G stacked on the discharge tray 43.

The above-described embodiment may be modified as follows.

In the above-described embodiment, the coupling member 67 is used to swing the guide portion 64. However, another configuration may be used to swing the guide portion 64. For example, an eccentric cam that is in contact with the guide portion 64 may be used, and a configuration where a driving force is transmitted to a gear provided at the first swinging shaft 661 via a speed reduction gear may be used.

In the above-described embodiment, the other end of the sheet member 21 is coupled with the slide member 24, and the slide member 24 is biased in the direction reverse to the conveyance direction Z. However, instead of this configuration, a configuration for winding the sheet member 21 may be adopted. For example, the other end of the sheet member 21 may be coupled with a rotatable shaft, and a spiral spring that biases the shaft in a direction of winding the sheet member 21 may be provided. With this configuration, a similar effect to that of the above-described embodiment is obtained.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A document sheet conveying device comprising:

a sheet feed tray on which a document sheet is stacked;

a discharge tray provided below the sheet feed tray;

a conveyance mechanism configured to convey the document sheet from the sheet feed tray to the discharge tray via a reading position;

a guide portion configured to, at a position downstream of the reading position in a conveyance direction of the document sheet, guide the document sheet to be conveyed;

a discharge outlet which is provided at a downstream end of the guide portion in the conveyance direction and through which the document sheet is discharged to the discharge tray;

a first swinging shaft provided at an upstream end of the guide portion in the conveyance direction, extending in a width direction intersecting the conveyance direction, and swingably supporting the guide portion;

a drive portion configured to swing the guide portion around the first swinging shaft;

a flexible sheet member having one end fixed to an upstream end of the discharge tray in the conveyance direction, and the other end supported by the guide portion, the sheet member which is, as the guide portion is lifted up, drawn out from a part of the guide portion below the discharge outlet, and is stretched between the guide portion and the upstream end of the discharge tray;

a biasing member having one end coupled with the guide portion and the other end coupled with the other end of the sheet member, the biasing member being configured to bias the sheet member in a drawn direction in which the sheet member is drawn into the guide portion; and a tension member provided along the width direction at a lower part of the guide portion below the discharge outlet, and configured to stretch the sheet member between the upstream end of the discharge tray in the conveyance direction and the lower part of the guide portion.

2. The document sheet conveying device according to claim 1, wherein the other end of the sheet member is supported by the guide portion in such a way as to be slidable along the drawn direction and a direction reverse to the drawn direction, and the biasing member biases the other end of the sheet member in the drawn direction.

3. The document sheet conveying device according to claim 1, further comprising:

a control portion configured to control swinging of the guide portion; and a sensor configured to detect an amount of document sheets stacked on the discharge tray, wherein the control portion controls the drive portion to swing the guide portion to change height of the discharge outlet according to the amount of the document sheets detected by the sensor.

4. The document sheet conveying device according to claim 1, further comprising:

a second swinging shaft provided at a position downstream of the first swinging shaft in the conveyance direction and extending in a same direction as the first swinging shaft; and a coupling member extending in an extension direction perpendicular to an axis direction of the second swinging shaft, one end of the coupling member in the extension direction being swingably supported by the second swinging shaft, the other end of the coupling member in the extension direction supporting the guide portion from below, wherein upon receiving a driving force supplied from the drive portion, the coupling member swings around the second swinging shaft, thereby causing the guide portion to swing.

5. The document sheet conveying device according to claim 1, wherein the guide portion includes:

a lower guide portion and an upper guide portion that form a conveyance path of the document sheet; and a pair of discharge rollers provided at the discharge outlet.

* * * * *